US005491887A

United States Patent [19]

Quinn

[11] Patent Number: 5,491,887

[45] Date of Patent: Feb. 20, 1996

[54] ELECTRICAL TERMINAL APPLICATOR WITH IMPROVED SPLIT CYCLE SYSTEM

[75] Inventor: Robert L. Quinn, St. Petersburg, Fla.

[73] Assignee: Molex Incorporated, Lisle, Ill.

[21] Appl. No.: 163,808

[22] Filed: Dec. 8, 1993

[51] Int. Cl.[6] ..... H01R 43/048

[52] U.S. Cl. ..... 29/753; 29/863

[58] Field of Search ..... 29/33, 747, 748, 29/739, 753, 566.2, 863, 759–761; 72/21, 26, 481; 100/48

[56] References Cited

U.S. PATENT DOCUMENTS

| | | | |
|---|---|---|---|
| 3,553,814 | 1/1971 | Rider | 29/753 |
| 3,641,647 | 2/1972 | Balmer | 29/739 X |
| 3,668,764 | 6/1972 | Randar | 29/753 X |
| 4,114,253 | 9/1978 | Loomis et al. | 29/753 X |
| 4,398,337 | 12/1983 | Yamaguti et al. | 29/564.6 |
| 4,557,045 | 12/1985 | Serrano | 29/747 |
| 4,924,693 | 5/1990 | College et al. | 72/453.03 |
| 5,033,187 | 7/1991 | Gloe et al. | 72/26 X |

OTHER PUBLICATIONS

Pp. 1–5 of Molex Mini–Mac Applicator Instruction Manual, Molex Inc., Illinois USA, date unknown.

*Primary Examiner*—Peter Dungba Vo

*Attorney, Agent, or Firm*—Charles S. Cohen

[57] ABSTRACT

An electrical terminal applicator is provided for crimping terminals onto electrical wires. An applicator ram is movable mounted on an applicator frame and is drivable by a press ram through a working stroke towards, and a return stroke away from, a crimping anvil. A crimping die is mounted on the applicator ram for cooperation with the anvil to crimp a portion of a terminal onto a wire during each working stroke of the applicator ram. A pneumatic piston-and-cylinder device is mounted directly on the applicator frame adjacent the applicator ram and is connected to the crimping die for moving the crimping die through a first portion of movement into engagement with an uncrimped terminal to preposition the terminal for crimping thereof. The crimping die is mounted for limited movement on the applicator ram such that the piston-and-cylinder device can move the crimping die through the first portion of movement and the applicator ram thereafter can move the crimping die through a second portion of movement to effect crimping of the terminal. A magnet is mounted on the applicator ram and is releasably engageable with the crimping die for moving the die with the ram away from the crimping anvil on the return stroke of the applicator ram.

15 Claims, 6 Drawing Sheets

ELECTRICAL TERMINAL APPLICATOR WITH IMPROVED SPLIT CYCLE SYSTEM

FIELD OF THE INVENTION

This invention generally relates to the art of electrical terminal applicators and, particularly, to an improved split cycle system for the crimping die means of the applicator.

BACKGROUND OF THE INVENTION

A known type of electrical terminal applicator includes an applicator ram drivable by a press ram through a working stroke towards, and a return stroke away from, a crimping anvil. The applicator ram has crimping die means for cooperation with the anvil to crimp at least a portion of an electrical terminal onto an electrical wire during each working stroke of the applicator ram. Often, the crimping die means include a first crimping die for crimping a first portion of the terminal onto a conductive core of an insulated electrical wire, and a second crimping die for crimping a second portion of the terminal onto the insulation of the wire. Various adjusting plates are provided for adjusting one of the crimping dies axially of the applicator ram as well as to adjust the shut height of the crimping die means.

Such electrical terminal applicators are often used with crimpable terminals that have a closed barrel and are secured together by some type of carrier such as thin plastic tape, continuously molded plastic or even metal strips. Such carriers can be fed to the crimping die means, and the leading terminal on the carrier is crimped onto a wire after which it is removed from the carrier. The terminal applicator is operated in a cyclical manner. After each crimping cycle and a succeeding uncrimped terminal is fed to the location of the crimping die means, a wire is fed to the located terminal, and this often is done in an automated machine. Therefore, if the located terminal is not precisely in position for receiving the electrical wire, problems can be encountered. For instance, the wire might be improperly inserted into the terminal, resulting in an ineffective or defective crimped connection. Still worse, a wire may substantially miss an improperly located terminal and cause jamming or damage to the crimping dies, anvil means or other components of the applicator.

A solution to the problem of improperly located terminals is to employ what is called a "split cycle press." In such presses, the press ram is moved through a first portion of its stroke a sufficient distance to have the crimping die means engage and locate but not crimp a terminal. A wire is then inserted into the terminal. The press ram then is moved through a second or complete portion of its stroke to effect crimping of the terminal onto the electrical wire. Such split cycle presses are considerably more expensive than standard presses which are widely used in the field with electrical terminal applicators. It would be an expensive proposition to replace all standard presses which are used with electrical terminal applicators with more expensive split cycle presses.

This invention is directed to providing a system directly on an electrical terminal applicator which is effective to provide a split cycle operation for the crimping die means of the applicator. Since such applicators often are interchangeable in presses, with or without some modifications, an applicator with a split cycle system would save considerable expenses in converting or replacing an entire standard press.

SUMMARY OF THE INVENTION

An object, therefore, of the invention is to provide a new and improved electrical terminal applicator with a novel split cycle system.

In the exemplary embodiment of the invention, an applicator ram is movably mounted on an applicator frame and is drivable by a press ram through a working stroke towards, and a return stroke away from, a crimping anvil. A crimping die is mounted on the applicator ram for cooperation with the anvil to crimp a portion of a terminal onto a wire during each working stroke of the applicator ram.

Generally, the invention contemplates the provision of moving means mounted directly on the applicator frame adjacent the applicator ram and connected to the crimping die for moving the crimping die through a first portion of movement into engagement with an uncrimped terminal to preposition the terminal for crimping thereof. Specifically, in the preferred embodiment of the invention, the moving means is provided by a pneumatic piston-and-cylinder device. Means are provided for mounting the crimping die for limited movement on the applicator ram such that the piston-and-cylinder device can move the crimping die through the first portion of movement thereof, and the applicator ram thereafter can move the crimping die through a second portion of movement to effect crimping of the terminal.

As disclosed herein, the axis of the piston-and-cylinder device is generally parallel to the working stroke of the applicator ram. The ram is reciprocally mounted in a housing portion of the applicator frame, and the piston-and-cylinder device is mounted on the outside of the housing portion. The crimping die has an arm projecting transversely outwardly of the housing portion for connection to the piston of the piston-and-cylinder device.

The invention also contemplates the provision of magnet means on the applicator ram engageable with the crimping die for moving the crimping die with the applicator ram away from the crimping anvil and a crimped terminal on the return stroke of the applicator ram. Stop means are engageable by the crimping die as the die is moved by the applicator ram during the return stroke thereof. The magnet means is disengaged from the crimping die by the stop means to allow the piston-and-cylinder device to again move the crimping die through its first portion of movement in a subsequent cycle of the applicator.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
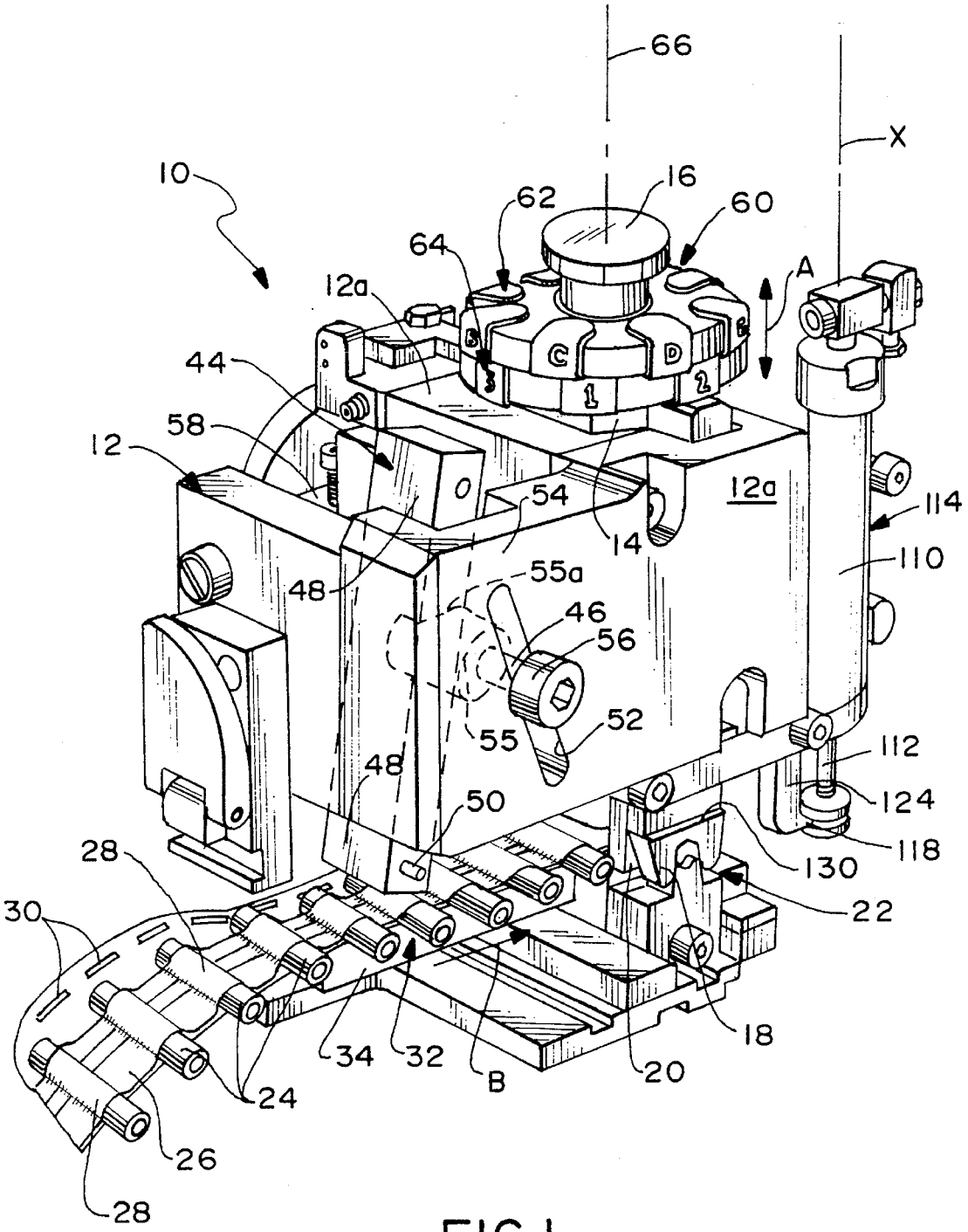
FIG. 1 is a perspective view of an electrical terminal applicator incorporating the concepts of the invention.

Referring to the drawings in greater detail, and first to FIG. 1, an electrical terminal applicator, generally designated 10, includes a frame, generally designated 12, which, in turn, includes an applicator ram housing 12*a* in which is mounted an applicator ram, generally designated 14, for vertical reciprocating motion within the housing in the direction of double-headed arrow "A". An adaptor head 16 projects upwardly of applicator ram 14 for engagement by a press ram which is not shown in the drawing but which is well known to those skilled in this art. An insulation crimping die 18 projects from the bottom of applicator ram 14, beneath housing 12*a*, and is juxtaposed with a conductive core crimping die 20 also projecting from the applicator ram beneath housing 12*a*. Die 18 is positioned forwardly of die 20 when viewed in FIG. 1. A crimping anvil means, generally designated 22, including a pair of crimping anvils 22*a* and 22*b* (FIG. 2), is located on frame 12 beneath crimping dies 18 and 20. In essence, the crimping dies and the crimping anvil means defines a crimping station of applicator 10.

In the general operation of applicator 10, applicator ram 14 is drivable by the press ram along a first path through a working stroke towards, and a return stroke away from, crimping anvil means 22, as indicated by double-headed arrow "A". Crimping dies 18 and 20 cooperate with crimping anvils 22*a* and 22*b*, respectively, to crimp an electrical terminal (described hereinafter) onto an electrical wire during each downward working stroke of applicator ram 14.

Applicator 10 is designed for seriatim crimping of a plurality of terminals 24 carried by a thin flexible tape 26, such as of plastic material. The terminals may be secured to the tape within integral cylindrical portions 28 of the plastic tape, with the terminals projecting transversely of the longitudinal dimensions of the tape. Actually, the tape has a dual thickness and cylindrical portions 28 are formed in the upper thickness, as shown. The tape has a series of indexing apertures or slots 30 lengthwise thereof.

Figure 2:
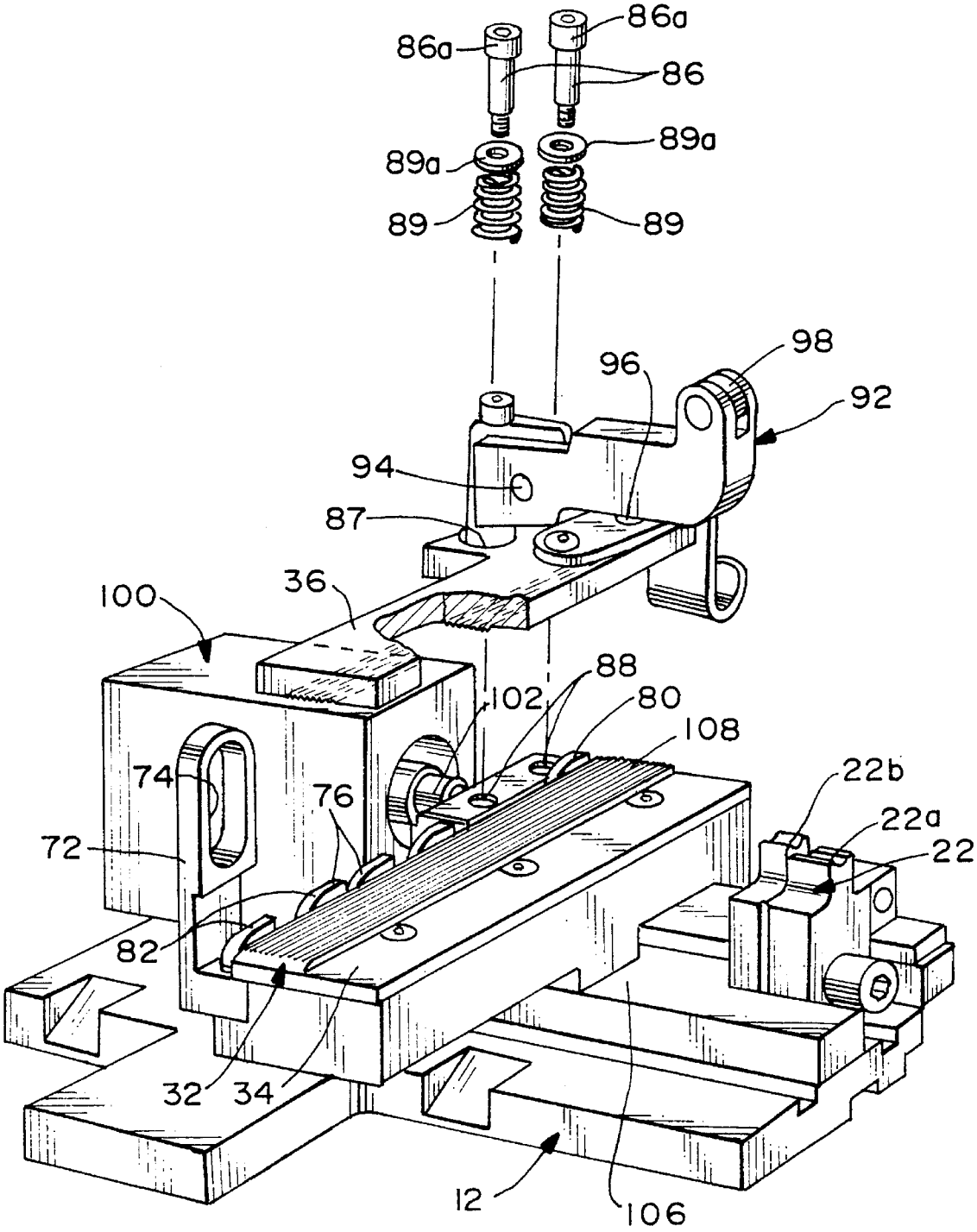
FIG. 2 is an exploded perspective view of the interior area of the applicator incorporating a terminal tape feeding system and a tape moving means.

Terminal tape 26 is fed into applicator 10 to a track means, generally designated 32, which guides the tape along a second path which generally perpendicularly intersects the first path of the applicator ram. Referring to FIG. 2, the track means includes a platen 34 for supporting the terminal tape, along with a longitudinal plate 36 to sandwich the apertured edge of tape 26 between the plate and the platen.

Still referring to FIG. 1, a terminal tape feeding linkage, generally designated 44, is assembled between frame 12 and housing 12*a* and includes a pivot bolt or screw 46, a feed link in the form of a rocker arm 48 and a drive connection including a rod 50 at the bottom of the rocker arm. Pivot bolt or screw 46 is adjustable lengthwise of a slot 52 in a brace portion 54 of frame 12 for purposes described hereinafter. Specifically, the bolt projects outwardly from a yoke 55 through slot 52 and has a locking nut 56 threaded to the distal end thereof. The yoke is free to rotate about the axis of the pivot bolt. The locking nut straddles the slot and bears against the outside of frame 12. The yoke straddles the slot and engages the inside of the frame. Therefore, tightening of the nut effects damping of the frame to fix the position of pivot bolt 46. The yoke has a groove 55*a* which embraces rocker arm 48 and slides along an edge thereof. Therefore, loosening of nut 56 allows the yoke to slide lengthwise of the rocker arm to change the location of pivot bolt 46 and, thereby, the pivot point of the rocker arm. Rocker arm or feed link 48 is swung about pivot pin 46 by a slidable rod 58 (by means not shown) for effecting feeding of terminal tape 26 along platen 34 in the direction of arrow "B" toward anvil means 22 to locate the leading uncrimped terminal 24 of the tape at the crimping station defined by the crimping dies and anvil means. As is known in the art, when the press ram drives applicator ram 14 downwardly as described above, crimping dies 18 and 20 are effective to crimp the lead terminal on tape 26 onto an electrical wire. The press ram/applicator ram are cycled in unison with the operation of feed link 48 to effect advancement of terminals 24 seriatim to the crimping station.

An adjusting plate assembly, generally designated 60, is provided for adjusting the shut heights of crimping die 18 and/or crimping die 20. The adjusting plate assembly includes first and second adjusting plates, generally designated 62 and 64, respectively, mounted for rotation about an axis 66 and include projections of various heights extending in the direction of movement of applicator ram 14. These adjusting plate assemblies are known in the art.

Up to this point, the above description of terminal applicator 10 is fairly known in the art of terminal applicators. The invention includes an improved feeding system for terminal tape 26. As will be understood hereinafter, the feeding system of this invention provides a very low profile in contrast to the feeding wheels of the prior art, and the system of this invention affords adjustment of the advancing stroke of the terminal tape to accommodate terminals secured to the tape on different pitches lengthwise thereof.

Figure 3:
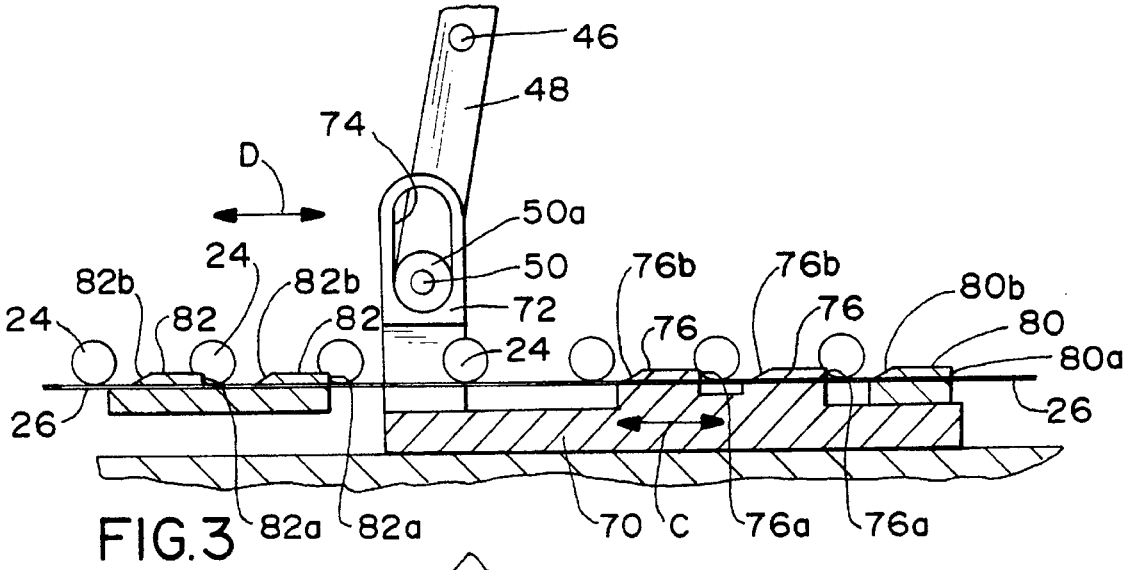
FIG. 3 is a somewhat schematic illustration of the shuttle member and stop teeth, with the shuttle member at a forward end of its stroke.
Figure 4:
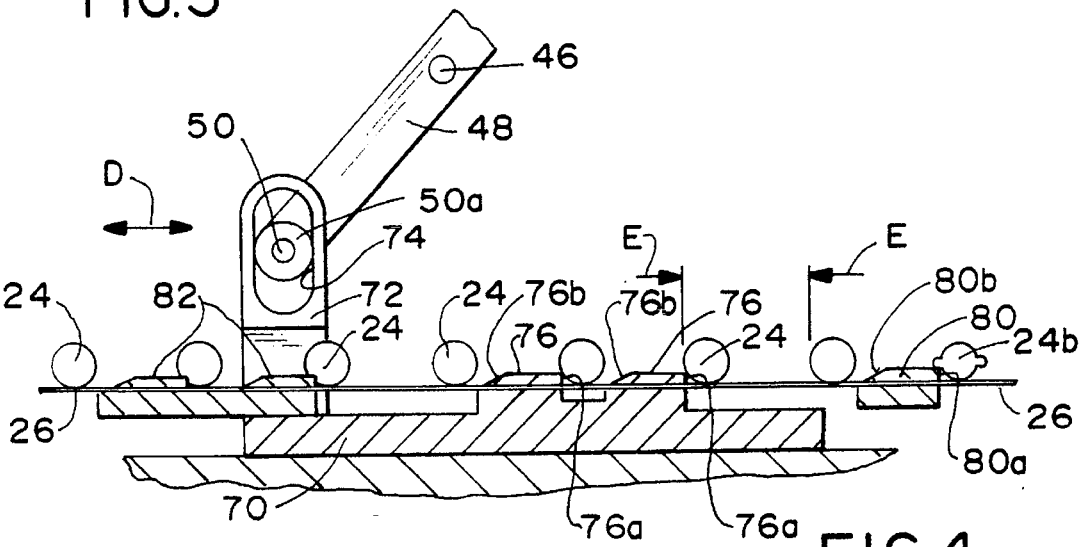
FIG. 4 is a view similar to that of FIG. 3, with the shuttle member at the rear end of its stroke.
Figure 5:
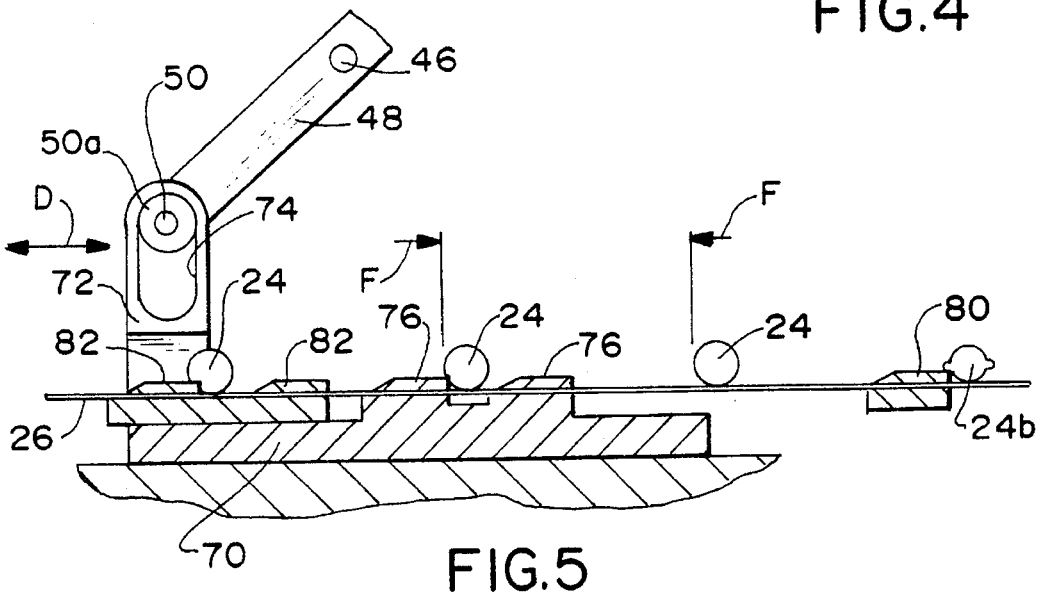
FIG. 5 is a view similar to that of FIG. 4, with the shuttle member shown at the rear end of a stroke which is longer than that of FIGS. 3 and 4.

More particularly, referring to FIGS. 3–5 in conjunction with FIG. 2, the tape feeding system of the invention includes a shuttle member 70 adapted for linear reciprocal movement alongside and parallel to the path of terminal tape 26 in an advancing stroke towards, and a return stroke away from, the crimping station at anvil means 22 (FIGS. 1 and 2). The direction of the stroke of the shuttle member is shown by double-headed arrow "C" in FIG. 3. The shuttle member is shown at the forward end of its advancing stroke in FIG. 3 and at the rear end of its return stroke in FIG. 4. The shuttle has an upwardly projecting arm 72 provided with a vertically elongated slot 74 for receiving drive rod 50 located at the bottom of feed link 48 (FIG. 1). Drive rod 50 is disposed within slot 74 of shuttle arm 72. In essence, oscillatory pivoting movement of feed link or rocker arm 48 is indicated by double-headed arrow "D" (FIG. 3) which, in turn, effects linear reciprocal movement of shuttle member 70 as indicated by double-headed arrow "C". The drive rod and the slotted shuttle arm provide complementary interengaging connecting means between the shuttle member 70 and the oscillating feed link 48 of the tape feeding means.

Generally, engagement means are provided on shuttle member 70 for engaging terminal tape 26 and incrementally advancing the tape on the advancing stroke of the shuttle member. More particularly, the shuttle member has a pair of upwardly projecting teeth 76 which are engageable in the indexing apertures 30 (FIG. 1) of tape 26. The teeth have abrupt vertical leading edges **76*a* for establishing a driving relationship with the leading edges of the indexing apertures 30 of tape 26 on the forward advancing stroke of the shuttle member. The teeth have chamfered trailing edges 76*b* for riding under the trailing edges of apertures 30 on the return stroke of the shuttle member. The rear end of the return stroke is shown in FIG. 4**. The length of the stroke is indicated by arrows "E".

Generally, stop means are provided for engaging the terminal tape 26 and preventing the tape from moving backward or away from the crimping station on the return stroke of shuttle member 70. More particularly, a single stop tooth 80 is located generally forwardly or upstream of shuttle member 70, and a pair of stop teeth 82 are located generally rearwardly or downstream of the shuttle member. Teeth 80 and 82 are appropriately fixed relative to the movement of the shuttle member and its teeth 76. Stop tooth 80 has an abrupt vertical leading edge **80*a* and stop teeth 82 have abrupt vertical leading edges 82*a* for stoppingly engaging the leading edges of indexing apertures 30 of terminal tape 26 as shuttle member 70 moves backward during its return stroke. Conversely, stop tooth 80 has a chamfered trailing edge 80*b*, and stop teeth 82 have chamfered trailing edges 82*b* for riding under the trailing edges of the indexing apertures. In other words, teeth 76, 80 and 82** are all similarly shaped.

Therefore, when shuttle member 70 and its teeth 76 incrementally advance the terminal tape toward the crimping station, the tape (along the line of the indexing apertures) ride over the rear chamfered edges **80*b* and 82*b* of stop teeth 80 and 82, respectively. When the shuttle member moves in its return stroke, the chamfered trailing edges 76*b* of the shuttle teeth 76 ride under the trailing edges of the indexing apertures as well as the material between the apertures, while the abrupt leading edges of stop teeth 80 and 82** engage the tape to prevent it from returning with the shuttle member.

With the unique feeding means of the invention, as described above, the stroke of shuttle member 70 can easily be adjusted. Specifically, referring to FIG. 5, an extended or lengthened stroke is shown by arrows "F", the extended stroke being approximately twice as long as stroke "E" in FIG. 4. This adjustment is made by changing the location of the pivot point for rocker arm 48 (i.e., pivot bolt 46) which, in turn, changes the length of the arc in which drive rod 50 oscillates. In other words, comparing FIGS. 3 and 4 wherein FIG. 3 shows the forward limit position of the shuttle and FIG. 4 shows the rear limit position of the shuttle for stroke "E", it can be seen that drive rod 50 moves in an arc about point 46, in response to pivoting of rocker arm 48, and oscillates back-and-forth between the bottom of slot 74 and the middle of the slot. Now, comparing FIG. 3 with FIG. 5, it can be seen that drive rod 50 moves back and forth between the extreme opposite ends of slot 74, as shuttle member 70 moves in twice the stroke as indicated by arrows "F" in FIG. 5.

In order to double the stroke of shuttle member 70, as described above in relation to FIGS. 3–5, reference is made back to FIG. 1 wherein it can be seen that pivot bolt 46 for rocker arm 48 has the locking nut 56 on the end thereof. The locking nut can be loosened so that the pivot bolt can be moved within elongated slot 52 in brace portion 54 of the applicator frame. The position of the pivot bolt within this slot determines the arcuate length of movement of the bottom of feed link or rocker arm 48 and, thereby, the arcuate movement of the drive connection with shuttle member 70, afforded by drive rod 50 within slot 74 of shuttle arm 72. Thus, by moving pivot bolt 46 upward, the length of the pivoting of arm 48 is increased, which thus increases the stroke of the shuttle member 70. When the desired extent of pivoting of rocker arm 48 is established, nut 56 is tightened to fix the position of pivot bolt 46. Drive rod 50 within slot 74 of shuttle arm 72 establishes a lost motion driving connection between rocker arm 48 and shuttle member 70 in order to convert arcuate movement of rod 50 to horizontal translational movement of shuttle member 70.

After a terminal 24 is crimped to a wire, the terminal and wire assembly must be removed from the tape 26 holding the terminals. This is accomplished by a tape moving means for moving the terminal tape 26 relatively away from crimping dies 18 and 20 when the dies are in crimping condition and in engagement with a crimped terminal 24, to break the crimped terminal away from the tape. In the preferred embodiment, applicator 10 employs at least a portion of platen 34 and guide plate 36 as the opposing jaws of a tape clamping means for engaging and gripping opposite surfaces of the tape and pulling the tape laterally of its second path of movement as indicated by arrow "B" (FIG. 1) away from crimping dies 18 and 20 and the crimped terminal.

Figure 6:
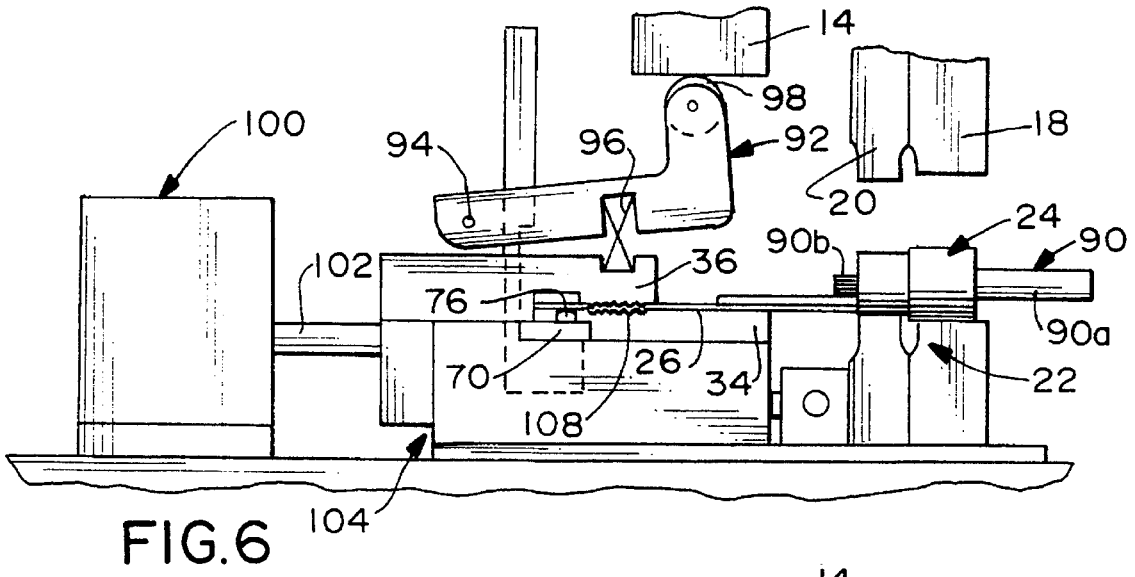
FIG. 6 is a somewhat schematic illustration of the terminal crimping means and terminal tape moving means in their inoperative condition.

More particularly, referring to FIGS. 2 and 6 in conjunction with FIG. 1, FIG. 6 shows an uncrimped terminal 24 supported by anvils **22*a* and 22*b* below crimping dies 18 and 20 which are raised or in their non-crimping condition. Tape 26 is shown in FIG. 6 with its rear or lateral edge opposite terminals 24 between a portion of platen 34 and a portion of guide plate 36. The tape is free to move along its second path of travel toward the applicator ram/crimping dies. Teeth 76 of shuttle member 70 which define the tape feeding means of the applicator also are seen in FIG. 6**.

Figure 7:
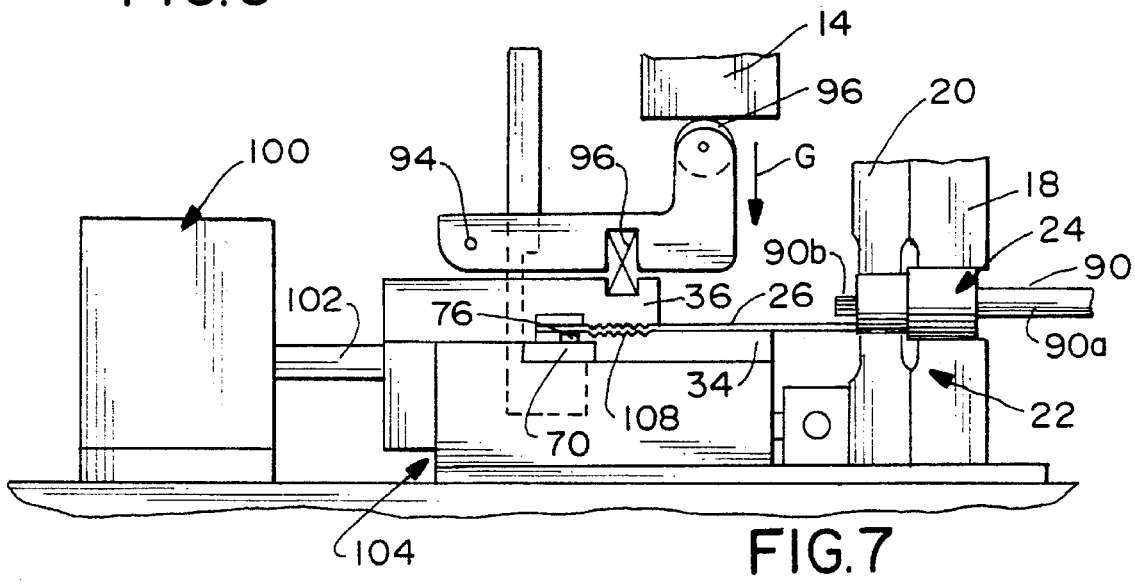
FIG. 7 is a view similar to that of FIG. 6, but with the crimping means in crimped condition and the tape moving means in clamping condition.

Before proceeding to FIG. 7, reference is made back to FIG. 2 wherein a pair of bolts 86 extend through a pair of countersunk holes 87 in guide plate 36 and are threaded into a pair of internally threaded holes 88, in platen 34. A pair of coil springs 89 surround bolts 86 and, when the bolts are threaded into holes 88, the coil springs are compressed between a pair of washers **89*a* abutting under the heads 86*a* of the bolts and the countersunk configuration of holes 87. This allows guide plate 36 to sort of "float" relative to platen 34 and allows the tape to move freely between the guide plate and the platen without binding. The bolts also provide a general pivot area for guide plate 36** when the guide plate is biased downwardly into gripping engagement with the tape as described below.

FIG. 7 shows applicator ram 14 having been driven downwardly in its working stroke as indicated by arrow "G". Dies 18 and 20 also can be seen having been driven downwardly into a crimping condition, crimping terminal 24 onto an electrical wire, generally designated 90. Actually, as is known in the art, crimping die 18 crimps a portion of the terminal onto the insulation 90*a* of the wire, and crimping die 20 crimps a portion of the terminal onto a stripped portion of the conductor 90*b* of the wire.

It also can be seen in FIG. 7 that applicator ram 14 has engaged an L-shaped lever, generally designated 92, which is pivoted on the applicator frame at 94. A spring, such as a coil spring 96, is sandwiched between lever 92 and guide plate 36. The end of the lever which engages applicator ram 14 is provided with a roller 98 to compensate for lost motion between the vertically linearly reciprocal ram and the arcuately rotatable lever. When lever 92 is driven downwardly by the applicator ram, from the position shown in FIG. 6 to the position shown in FIG. 7, spring 96 is compressed and biases guide plate 36 toward platen 34 to clamp the rear edge of terminal tape 26 therebetween. The compressed force of spring 96 overcomes the spring load of springs 89 (FIG. 2) to pivot the floating guide plate downwardly.

Figure 8:
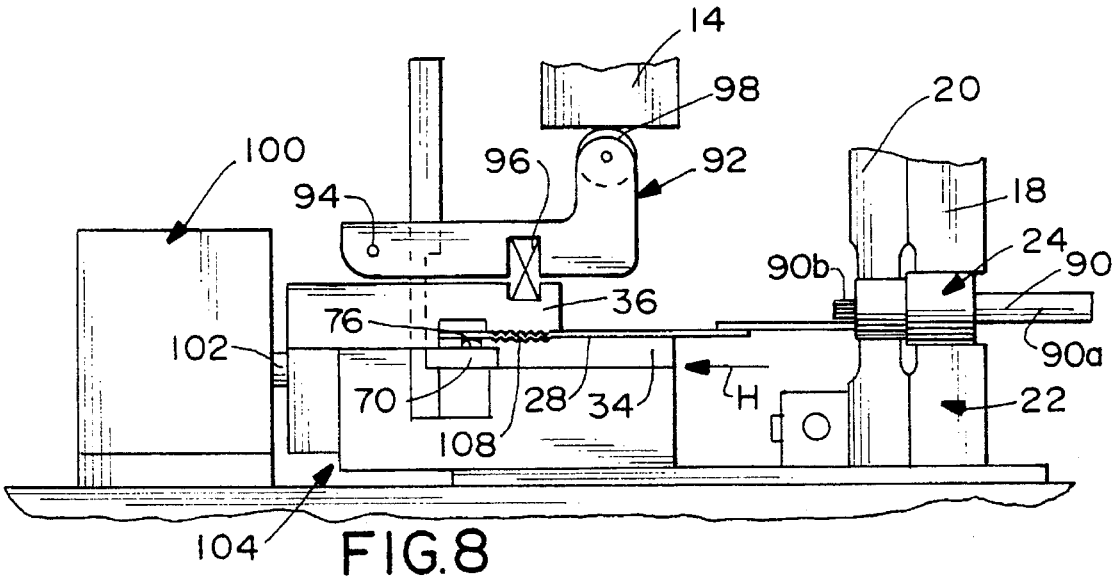
FIG. 8 is a view similar to that of FIG. 7, with the tape moving means having been moved laterally to break the crimped terminal away from the tape.

Now, referring to FIG. 8, it can be seen that a piston and cylinder device, generally designated 100, includes a piston 102 connected to a movable assembly, generally designated 104, which includes platen 34 and guide plate 36. The assembly is movable in a track 106 of frame 12 (see FIG. 2). The piston and cylinder device is effective to move the platen and guide plate assembly 104 in the direction of arrow "H" (FIG. 8) away from crimping dies 18 and 20 when the dies are in crimping condition and in engagement with a crimped terminal. With tape 26 clamped between platen 34 and guide plate 36, this movement also is effective to move the tape in the direction of arrow "H" and effectively break the crimped terminal away from the tape.

In order to further facilitate gripping of the opposite surfaces of tape 26, one or both of the platen 34 and/or the guide plate 36 can be provided with serrations 108 on the clamping surfaces thereof. This is seen best in FIG. 2 wherein the serrations are formed by ridges extending parallel to the feeding path of the terminal tape which, in turn, is perpendicular to the pulling direction on the tape as indicated by arrow "H" (FIG. 8). With the platen and guide plate assembly 104 being actuated by a pneumatic device such as piston and cylinder device 100, it is well within the understanding of one skilled in this art that it would be known to cycle the operation of the pneumatic piston and cylinder device with the cycle of operation of the pneumatic press ram which operates applicator ram 14, as is known in the art. After the ram 14 begins to rise from its crimped condition, piston and cylinder device 100 operates to move the movable assembly 104 including the tape 26 and uncrimped terminals 24 back to the position shown in FIG. 6.

A system for converting an ordinary press and applicator so that it operates like a split cycle press is shown in the somewhat schematic illustrations of FIGS. 9– 16. In those views, applicator ram 14 is shown in conjunction with one of the crimping dies 18 or 20, along with a piston-and-cylinder device, generally designated 110, which includes a piston 112 projecting from the bottom of a cylinder 114, the device being pneumatically operated, such as an air cylinder. The device is mounted to the side of ram housing portion 12*a* of frame 12 (FIG. 1), and the piston projects through a cross brace 116 on the frame (FIGS. 9–16) and is connected at the distal end of the piston, as at 118, to crimping die 18. Anvil means 22 also are shown in FIGS. 10, 12, 14 and 16, and terminals 24 of terminal tape 26 (FIG. 1) are simply shown by a line or series of circles in these figures. Finally, for purposes to be described in greater detail hereinafter, magnet means in the form of one or more rare earth magnets 120 are mounted on applicator ram 14 for engaging and releaseably retaining a top portion 122 (see FIG. 9, for instance) of crimping die 18. In the alternative, other mechanisms such as a spring loaded latching structure could be utilized to releasably engage and release the crimp die 18.

Figure 10:
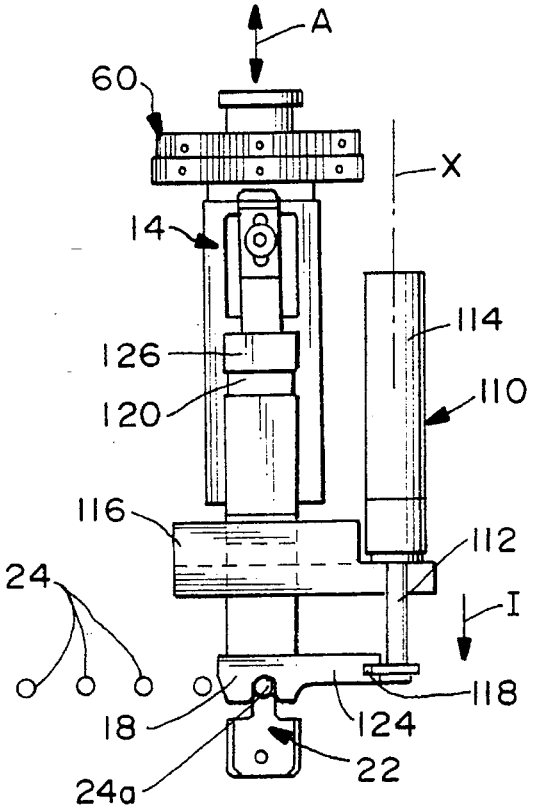

The axis of the piston-and-cylinder device 110 is shown at "X" (FIG. 10). The axis is generally parallel to the working stroke "A" of applicator ram 14. An arm 124 of the crimping die(s) projects laterally outwardly for connection to the distal end of piston 112 at 118.

Figure 9:
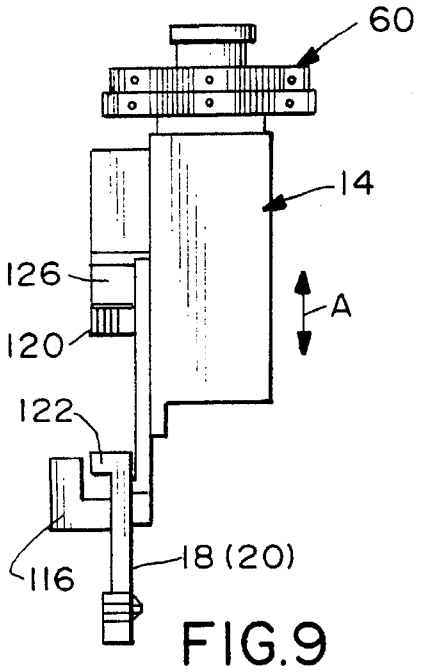
FIGS. 9 and 10 are somewhat schematic side and front elevational views, respectively, of the applicator ram, crimping die, anvil means and the piston-and-cylinder device isolated from the entirety of the applicator to illustrate the preposition condition of the crimping die in the first portion of the split cycle system.

The operation of the system in terminal applicator 10 now will be described. Referring first to FIGS. 9 and 10, piston 112 can be seen to have moved crimping die 18 downwardly in the direction of arrow "I" where the die has sandwiched an uncrimped terminal 24*a* between the die and anvil means 22. This is considered the preposition of the crimping die. In other words, the pneumatic piston-and-cylinder device has moved crimping die 18 through a first portion of movement into engagement with an uncrimped terminal to preposition the terminal prior to crimping thereof. This action properly locates the terminal so that an electrical wire can be accurately inserted into the prepositioned terminal, particularly when using an automated machine. The gripping force exerted on the uncrimped terminal 24*a* by piston 112 through crimping die 18 and anvil means 22 can be changed by adjusting the pressure in cylinder 114. This occurs because the stroke of piston 112 is sufficiently long so that it would completely close the die and anvil if a terminal were not positioned therebetween.

Figure 11:
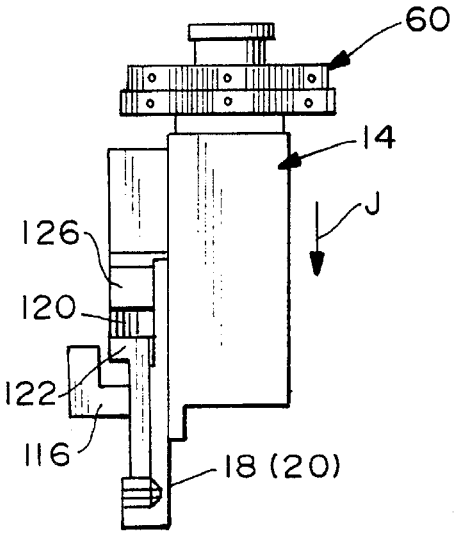
FIGS. 11 and 12 are views similar to FIGS. 9 and 10, respectively, with the applicator ram and crimping die being moved to a crimping position during the second portion of the split cycle system.
Figure 12:
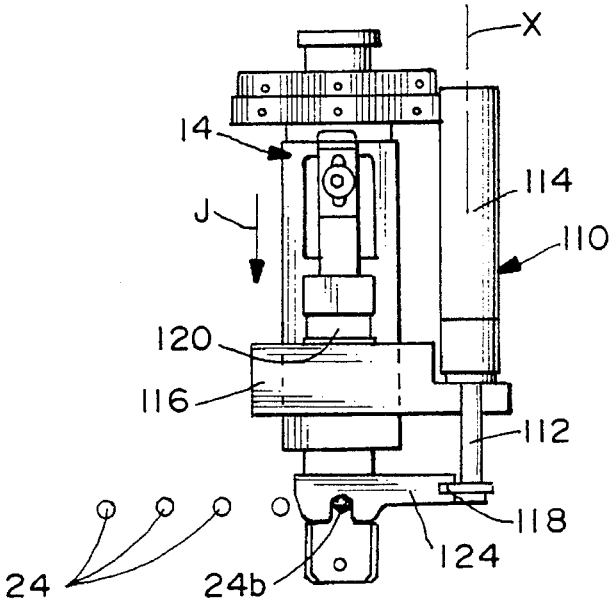

Referring to FIGS. 11 and 12, applicator ram 14 has been driven downwardly in the direction of arrow "J", so that a driving shoulder portion 126 thereof which mounts magnets 120 engages top portion 122 of crimping die 18 and drives the die through a second portion of movement to effect crimping of the prepositioned terminal. The crimped terminal is shown at 24*b*. In other words, FIGS. 9 and 10 show the first portion of movement of the crimping die, and FIGS. 11 and 12 show the second portion of movement of the crimping die, i.e. the split cycle of operation of the die.

Figure 13:
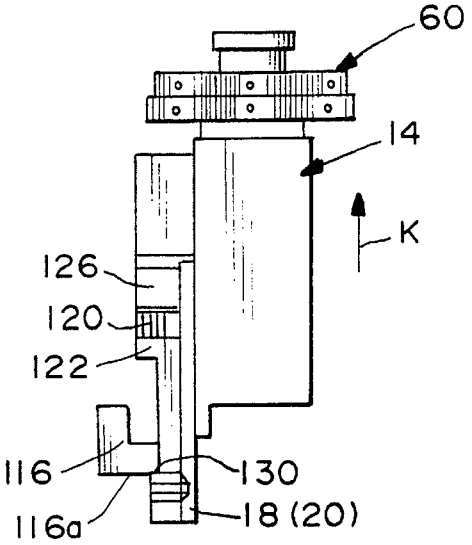
FIGS. 13 and 14 are views similar to that of FIGS. 11 and 12, respectively, with the crimping die being moved away from a crimped terminal during the return stroke of the applicator ram.
Figure 14:
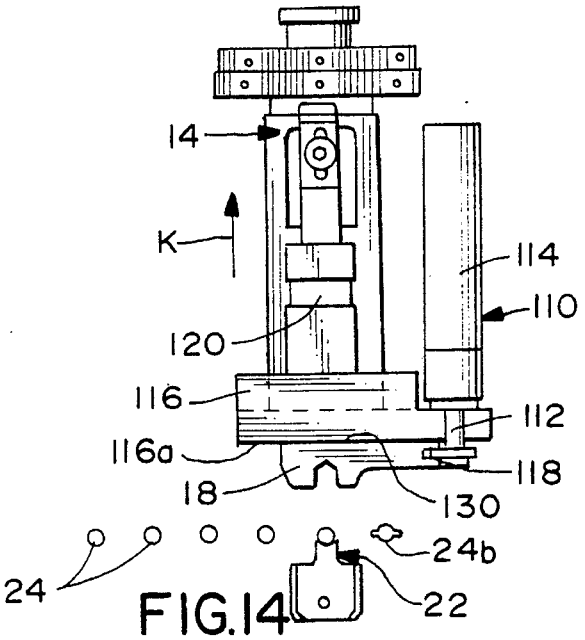

FIGS. 13 and 14 show applicator ram 14 and crimping die 18 being moved upwardly or away from anvil means 22. The crimping die is fabricated of highly magnetically attractable material, such as a ferrous metal or the like, and magnets 120 are effective to engage and magnetically "grasp" top portion 122 of crimping die 18 and pull the die upwardly with the applicator ram in the direction of arrow "K". This action forces piston 112 back upwardly into cylinder 114. The applicator ram will pull the crimping die upwardly by means of magnets 120, until a ledge 130 (FIGS. 1, 13, 14) on the crimping die abuts against the bottom surface 116*a* of brace 116 which defines a stop means to limit the upward movement of the crimping die.

Figure 15:
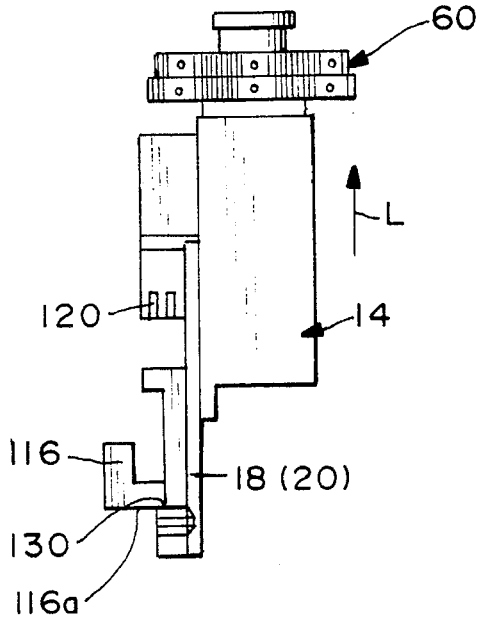
FIGS. 15 and 16 are views similar to that of FIGS. 13 and 14, respectively, with the applicator ram back at the end of its full return stroke and the magnet being disengaged from the crimping die.
Figure 16:
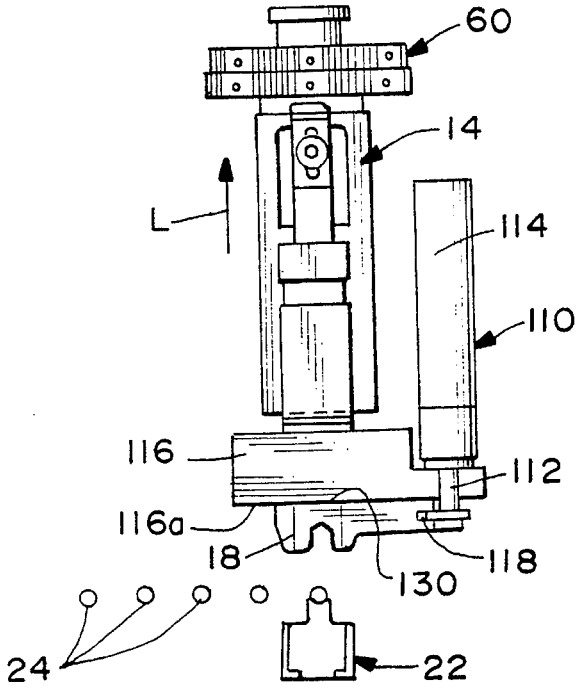

Referring to FIGS. 15 and 16, with crimping die 18 being stopped by bottom surface 116*a* of brace 116, applicator ram 14 continues to move upwardly in the direction of arrow "L", as the magnets are pulled away from the top of the crimping die. The applicator ram now is at the upper limit position of its return stroke. With magnets 120 now being spaced from crimping die 18, piston-and-cylinder device 110 can again drive the crimping die down to its preposition as described above in relation to FIGS. 9 and 10, to begin the next cycle of operation of the applicator.

It should be understood that piston-and-cylinder device 110 could be used to exert an upward force on crimping die 18 to force the die away from its crimped position and back to the beginning of a new cycle of operation. However, it must be understood that these crimping cycles are very short in relative time—the length of a single cycle being on the order of 250 milliseconds. Therefore, it is difficult and/or expensive to properly time the actions of a pneumatic device in such a short period of time. Consequently, magnets 120 are used as a "mechanical latch" which does not depend in any way upon a timing circuit or cycle. A blast of air may be cycled into cylinder 114 simply to assist in breaking the crimping die 18 away from a crimped terminal, but the magnet means is the primary force for lifting and returning the crimping die back to its upper position for the next cycle of operation. This also assists in the event the crimping tooling and terminal jam or bind together as the tooling is supposed to disengage from the terminal.

Although the applicator 10, shown in FIGS. 1–8, is configured for use with tape 26 carrying closed barrel terminals 24, it should be understood that the tape moving system described herein can be utilized with any type of terminal, closed barrel or not, that is carried by tape. The feeding system can be used with any type of terminal, regardless of the type of carrier. Similarly, the system for converting an ordinary press to operate like a split cycle press can operate with any type of closed barrel terminal, regardless of the type of carrier. That is, it can be used with closed barrel terminals that are carried on plastic tape, continuously molded plastic carriers, metal carriers or even loose piece parts delivered in an automated manner. With such other types of carriers, the feeding system and manner of removing the terminals from the carrier would be modified compared to that shown herein, as is known in the art.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical terminal applicator for removably mounting in a crimp press to crimp closed barrel terminals onto electrical wires, including an applicator frame, an applicator ram movably mounted on the frame and drivable by a press ram through a working stroke towards, and a return stroke away from, a crimping anvil, a crimping die movably mounted on the applicator for cooperation with the anvil to crimp a portion of a terminal onto a wire during each working stroke of the applicator ram, wherein the improvement comprises:

a pneumatic piston-and-cylinder device mounted on the applicator frame adjacent the applicator ram and connected to the crimping die for moving the crimping die independent of the applicator ram through a first portion of movement into engagement with an uncrimped terminal to preposition the terminal for crimping thereof, whereby the applicator ram subsequently moves the crimping die through a second portion of movement to effect crimping of the terminal.

2. In an electrical terminal applicator as set forth in claim 1, wherein the axis of the piston-and-cylinder device is generally parallel to the working stroke of the applicator ram.

3. In an electrical terminal applicator as set forth in claim 2, wherein said applicator ram is reciprocally mounted in a housing portion of the applicator frame, and the piston-and-cylinder device is mounted on the outside of the housing portion.

4. In an electrical terminal applicator as set forth in claim 3, wherein said crimping die has an arm portion projecting transversely outwardly of said housing portion for connection to the piston of said piston-and-cylinder device.

5. In an electrical terminal applicator as set forth in claim 1, including magnet means on the applicator ram releaseably engageable with the crimping die for moving the crimping die with the applicator ram away from the crimping anvil and a crimped terminal on the return stroke of the applicator ram.

6. In an electrical terminal applicator as set forth in claim 5, including stop means engageable by the crimping die as it is moved by the applicator ram during the return stroke thereof such that the magnet means is disengaged from the crimping die to allow the piston-and-cylinder device to again move the crimping die through said first portion of movement thereof in a subsequent cycle of the applicator.

7. In an electrical terminal applicator for removably mounting in a crimp press to crimp closed barrel terminals onto electrical wires, including an applicator frame, an applicator ram movably mounted on the frame and drivable by a press ram through a working stroke towards, and a return stroke away from, a crimping anvil, a crimping die movably mounted on the applicator for cooperation with the anvil to crimp a portion of a terminal onto a wire during each working stroke of the applicator ram, wherein the improvement comprises:

moving means mounted on the applicator frame adjacent the applicator ram and connected to the crimping die for moving the crimping die independent of the applicator ram through a first portion of movement into engagement with an uncrimped terminal to preposition the terminal for crimping thereof, whereby the applicator ram subsequently moves the crimping die through a second portion of movement to effect crimping of the terminal.

8. In an electrical terminal applicator as set forth in claim 7, wherein said applicator ram is reciprocally mounted in a housing portion of the applicator frame, and said moving means are mounted on the outside of the housing portion.

9. In an electrical terminal applicator as set forth in claim 7, including lifting means on the applicator ram releasably engageable with the crimping die for moving the crimping die with the applicator ram away from the crimping anvil and a crimped terminal on the return stroke of the applicator ram.

10. In an electrical terminal applicator as set forth in claim 9, including stop means engageable by the crimping die as the die is moved by the applicator ram during the return stroke thereof such that the lifting means is disengaged from the crimping die to allow the moving means to again move the crimping die through said first portion of movement thereof in a subsequent cycle of the applicator.

11. In an electrical terminal applicator as set forth in claim 9, wherein said lifting means comprises a magnet releasably engageable with a magnetically attractable portion of the crimping die.

12. In a crimp press for crimping closed barrel terminals onto electrical wires, including a frame, a ram movably mounted on the frame and drivable through a working stroke towards, and a return stroke away from, a crimping anvil, a crimping die movably mounted on the crimp press for cooperation with the anvil to crimp a portion of a terminal onto a wire during each working stroke of the ram, wherein the improvement comprises:

lifting means on the ram releasably engageable with the crimping die for moving the crimping die with the ram away from the crimping anvil and a crimped terminal on the return stroke of the ram; and stop means engageable by the crimping die as it is moved by the ram during its return stroke such that the lifting means is disengaged from the crimping die before the ram completes its return stroke.

13. In a crimp press as set forth in claim 12, wherein said lifting means comprises a magnet releasably engageable with a magnetically attractable portion of the crimping die.

14. In an electrical terminal applicator for removably mounting in a crimp press to crimp closed barrel terminals onto electrical wires, including an applicator frame, an applicator ram movably mounted on the frame and drivable by a press ram through a working stroke towards, and a return stroke away from, a crimping anvil, a crimping die movably mounted on the applicator for cooperation with the anvil to crimp a portion of a terminal onto a wire during each working stroke of the applicator ram, wherein the improvement comprises:

moving means mounted on the applicator frame adjacent the applicator ram and connected to the crimping die for moving the crimping die through a first portion of movement into engagement with an uncrimped terminal to preposition the terminal for crimping thereof, whereby the applicator ram subsequently moves the crimping die through a second portion of movement to effect crimping of the terminal, lifting means on the applicator ram releasably engageable with the crimping die for moving the crimping die with the applicator ram away from the crimping anvil and a crimped terminal on the return stroke of the applicator ram, and stop means engageable by the crimping die as it is moved by the applicator ram during the return stroke thereof such that the lifting means is disengaged from the crimping die to allow the moving means to again move the crimping die through said first portion of movement thereof in a subsequent cycle of the applicator.

15. In an electrical terminal applicator as set forth in claim 14 wherein said lifting means comprises a magnet releasably engageable with a magnetically attractable portion of the crimping die.

* * * * *